United States Patent [19]

Brown et al.

[11] Patent Number: 4,542,704

[45] Date of Patent: Sep. 24, 1985

[54] THREE-STAGE PROCESS FOR BURNING FUEL CONTAINING SULFUR TO REDUCE EMISSION OF PARTICULATES AND SULFUR-CONTAINING GASES

[75] Inventors: Melvin H. Brown, Freeport; David H. DeYoung, Plum, both of Pa.

[73] Assignee: Aluminum Company of America, Pittsburgh, Pa.

[21] Appl. No.: 681,672

[22] Filed: Dec. 14, 1984

[51] Int. Cl.[4] ..... F23D 1/00

[52] U.S. Cl. ..... 110/347; 110/229; 110/342; 110/343; 110/345

[58] Field of Search ..... 110/229, 347, 263, 345, 110/342, 343, 344

[56] References Cited

U.S. PATENT DOCUMENTS

| | | | |
|---|---|---|---|
| 1,007,153 | 10/1911 | Spurrier . | |
| 1,167,471 | 1/1916 | Barba . | |
| 1,545,620 | 7/1925 | Trent . | |
| 1,955,574 | 4/1934 | Benner et al. | 110/28 |
| 2,800,172 | 7/1957 | Romer et al. | 158/1 |
| 3,228,451 | 1/1966 | Fraser et al. | 158/117.5 |
| 3,313,251 | 4/1967 | Jonakin | 110/7 |
| 3,540,387 | 11/1970 | McLaren et al. | 110/1 |
| 3,717,700 | 2/1973 | Robison et al. | 423/244 |
| 4,102,277 | 7/1978 | Wall | 110/342 |
| 4,144,017 | 3/1979 | Barsin et al. | 431/10 |
| 4,232,615 | 11/1980 | Brown | 110/342 |
| 4,253,409 | 3/1981 | Wormser | 110/347 |
| 4,381,718 | 5/1983 | Carver et al. | 110/347 |
| 4,407,206 | 10/1983 | Bartok et al. | 110/347 |

*Primary Examiner*—Edward G. Favors

*Attorney, Agent, or Firm*—Andrew Alexander; John P. Taylor

[57] ABSTRACT

A three-stage combustion process is disclosed for burning a fuel containing sulfur characterized by low sulfur emission and good ash removal. The process comprises mixing the sulfur containing fuel with an additive capable of reacting with sulfur; burning the mixture in a first combustion stage with less than 75% theoretical air and at a temperature below the melting point of the ash but sufficiently high to cause reaction between the additive and any sulfur in the fuel to facilitate removal of the sulfur compounds formed; removing at least a portion of the sulfur compounds formed in the first stage; passing combustible gases from the first stage to a second stage; burning the gases in the second stage with less than 100% theoretical air at a temperature above the melting point of the ash to form a liquid slag which is removable from the second stage; and burning combustible gases from the second stage in a third stage with an excess of air to ensure complete combustion of the fuel.

19 Claims, 2 Drawing Figures

THREE-STAGE PROCESS FOR BURNING FUEL CONTAINING SULFUR TO REDUCE EMISSION OF PARTICULATES AND SULFUR-CONTAINING GASES

BACKGROUND OF THE INVENTION

1. Technical Field of the Invention

This invention relates to an improved process for burning a fuel containing sulfur. More particularly, the invention relates to a process for burning a fuel containing sulfur in three stages to reduce the emission of particulates and sulfur compounds in the combustion gases.

2. Background Art

The combustion of fuels containing sulfur as well as incombustible ash-forming residues results in the need to control emission of particulates and sulfur compounds for environmental reasons. Since these sulfur compounds and particulates may constitute significant environmental hazards, much work has been devoted to the development of methods for preventing formation of these substances or cleansing them from the combustion gases.

With respect to the presence of sulfur in the fuel, it has been proposed to add materials to the fuel which will, at least at the combustion temperature, react with the sulfur to form sulfur compounds which may be removed, i.e. to prevent or mitigate the formation of sulfur oxide gases. Spurrier U.S. Pat. No. 1,007,153 proposed the addition of a salt, hydrate or oxide of one of the alkali metals as an additive to coke whereby the alkali would be carried into the pores of the coke where it may react with the sulfur upon heating to form sulfates and sulfides.

Trent U.S. Pat. No. 1,545,620 described saturating pulverized coke with water and co-mingling this with a mixture of pulverized limestone and hydrocarbon oil to form a plastic mass in which there is a close association between the sulfur and the limestone. When the mixture is coked, the limestone and sulfur react to form calcium sulfide.

McLaren et al U.S. Pat. No. 3,540,387 describes the addition of a carbonate, such as calcium carbonate, to a fluidized bed containing coal so that the sulfur is retained in the bed.

Robison et al U.S. Pat. No. 3,717,700 describes the use of a sulfur acceptor material in a first combustion zone to absorb the sulfur and then release it in a second zone to therefore concentrate most of the sulfur oxides in a small fraction of the flue gas.

Wall U.S. Pat. No. 4,102,277 describes incinerating sewage which has been dewatered with the aid of lime and then incinerated using high sulfur fuel. During incineration, the lime reacts with the sulfur in the fuel and with oxygen to form calcium sulfate for disposal and to prevent formation of polluting sulfur oxide gases.

It is also known to mix fuel with an additive to control or alter the melting or softening point of the ash or slag formed to facilitate removal thereof. Barba U.S. Pat. No. 1,167,471 discloses the addition of clay to powdered coal to raise the melting point of the ash to form a more satisfactory coating on metals being heat treated.

Benner et al U.S. Pat. No. 1,955,574 adds a reagent to coal to alter and/or control the melting or softening point of the slag to protect the furnace walls from molten slag. The softening point of coal ash is said to be raised by the addition of sand or a non-ferruginous clay or lowered by the addition of lime or soda. The melting or softening point is controlled by the patentee to permit the build-up of a thin layer of solid slag on the furnace walls to protect the refractory walls from molten slag which is formed in the interior of the furnace.

Romer et al U.S. Pat. No. 2,800,172 relates to the addition of a metal or a metal oxide, e.g. aluminum, magnesium or calcium, to a liquid fuel to alter the form of slag produced in a combustion chamber to an easily removed slag.

The controlling of the combustion temperature to insure the production of a molten slag to thereby reduce airborne particulates is also known. Jonakin U.S. Pat. No. 3,313,251 describes a method for processing coal slurries containing crushed coal and water wherein the temperature in the furnace is maintained above the melting point of the ash in the coal so that a molten residue is produced by the combustion process. The centrifugal action produced in a cyclone furnace causes this residue to impinge on the furnace walls where, under the influence of gravity, it flows to the bottom of the furnace where it may be removed.

It is also known to burn fuel in more than one stage to reduce smoke and sulfur oxide production by providing an air-fuel ratio in the first stage less than that for stoichiometric burning. Fraser et al U.S. Pat. No. 3,228,451 proposed burning fuel in such a two stage process wherein the fuel was burned in a first stage at an air-fuel ratio less than that for stoichiometric burning. The products of this combustion were then cooled and subsequently burned in a second stage with an excess of air which resulted in a lowering of the burning temperature.

Barsin U.S. Pat. No. 4,144,017 proposed burning fuel in several stages wherein the combustion air delivered to a primary furnace was regulated to introduce 50 to 70% of total stoichiometric air while maintaining the maximum combustion temperature at or below 2500° F. to reduce the formation of nitric oxides. The combustion air delivered to the second stage or secondary furnace is also regulated to introduce 50 to 70% of total stoichiometric air to the second furnace while maintaining a combustion temperature at or below 2900° F.

In Brown U.S. Pat. No. 4,232,615, assigned to the assignee of this invention, a process was disclosed for burning a pulverized carbonaceous material containing sulfur and ash wherein an additive was used capable of reacting during combustion with the sulfur in the material, and the fuel was burned in two stages where the first stage contained less than 100% of the theoretical air and was preferably at a temperature below 1100° C. to thereby inhibit the formation of undesirable sulfur oxide gases and to assist in the removal of the sulfur as solid compounds. It was proposed therein that the first stage could be maintained at a temperature either below or above the melting point of the ash depending upon the desired conditions. It was further suggested that the additives used for reacting with the sulfur to form sulfur compounds might also have an effect upon the overall melting point of the ash either reducing or raising it, depending upon the particular compound used.

While all of the foregoing processes contributed to the reduction of the sulfur and/or particulates in the emissions from combustion processes, most of the processes either favor the removal of sulfur or the formation of an easily recoverable ash. For example, in the aforementioned Brown patent, if the slurry is burned in the first stage with less than 100% theoretical air at a temperature below the melting point of the ash, the sulfur removal is good both from the standpoint of the limitation of air aiding in the formation of thermally stable sulfide compounds rather than sulfites, and the reduced temperature preventing any sulfite compounds formed from decomposing to undesirable sulfur oxide gases. In addition, the reaction between the additives and sulfur is enhanced by the large surface area of the fine particulate particles. Furthermore, the reduced temperature reduces the formation of oxides of nitrogen as well.

However, the lower temperature, while being useful in more completely eliminating sulfur emissions, increases the problem with regard to particulates in the emissions since the combustion temperature is below the melting point of the ash and the ash, therefore, remains in a particulate form which is more difficult to remove from the gases.

On the other hand, if the first stage is carried out at a temperature above the melting point of the ash, any sulfite compounds formed may be more easily decomposed to the undesirable sulfur oxide emissions. Furthermore, the relatively small surface area of the molten slag on the burner wall slows down the reaction between additives and sulfur.

Thus, operation of the prior art processes represented a compromise at best wherein either the elimination of sulfur or the elimination of the particulates was preferred to the detriment of the other. It would, therefore, be highly desirable to provide a process wherein both sulfur and particulate removal was optimized to therefore reduce the emission of both of these undesirable material from the combustion process.

SUMMARY OF THE INVENTION

It is, therefore, an object of this invention to provide a three-stage process for burning combustible fuel containing sulfur and ash-forming materials wherein the emission of particulates and sulfur-bearing gases is reduced.

It is another object of this invention to provide a three-stage process for burning combustible fuel containing sulfur and ash-forming materials wherein the emission of particulates and sulfur-bearing gases is reduced by providing a stage which optimizes removal of sulfur impurities.

It is yet another object of this invention to provide a three-stage process for burning combustible fuel containing sulfur and ash-forming materials wherein the emission of particulates and sulfur-bearing gases is reduced by providing a stage which optimizes removal of ash formed in the combustion process.

It is a further object of this invention to provide a three-stage process for burning combustible fuel containing sulfur and ash-forming materials wherein the emission of particulates and sulfur-bearing gases is reduced by providing a stage which optimizes removal of sulfur impurities, another stage which optimizes removal of ash formed in the combustion process, and a final stage which ensures complete combustion of any remaining fuel values.

It is still a further object of the invention to provide a three-stage process wherein less than 100% theoretical air is used in the first two stages to respectively aid in the formation of sulfides and ash which are respectively removed prior to complete combustion of the remaining gases in the third stage.

It is another object of the invention to provide a three-stage combustion process for burning a combustible fuel containing sulfur and ash-forming materials wherein an additive is mixed with the fuel to react with the sulfur to form a more easily removable compound.

It is yet a further object of the invention to provide a three-stage combustion process for burning a combustible fuel containing sulfur and ash-forming materials wherein an additive is mixed with the fuel to react with the sulfur to form a removable compound and a binding agent is also added to the fuel to further reduce emission of particulates during the combustion process.

These and other objects of the invention will be apparent from the following description and accompanying drawings.

In accordance with the invention, a three-stage combustion process for burning a fuel containing sulfur characterized by low sulfur emission and good ash removal comprises mixing the sulfur containing fuel with an additive capable of reacting with sulfur, burning the mixture in a first combustion stage with less than 75% theoretical air and at a temperature below the melting point of the ash, but sufficiently high to cause reaction between the additive and any sulfur in the fuel to facilitate removal of the sulfur compounds formed, passing combustible fuel gases and particulates from the first stage to a second combustion stage, burning the gases in the second stage with less than 100% theoretical air at a temperature above the melting point of the ash to form a liquid slag which is removable from the second stage, and burning combustible gases from the second stage in a third stage with an excess of air to ensure complete combustion of the fuel.

DESCRIPTION OF THE PREFERRED EMBODIMENTS

Figure 1:
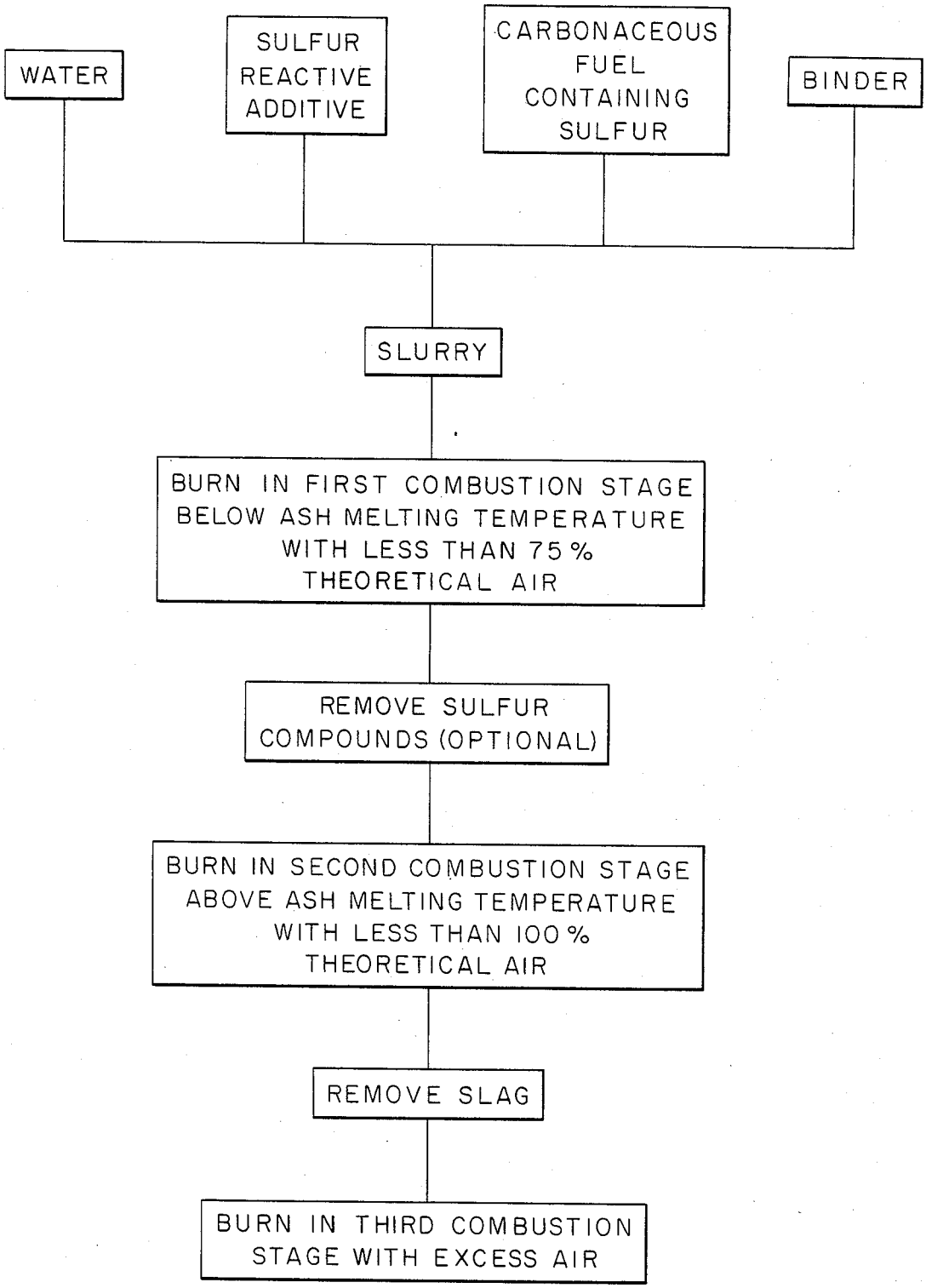
FIG. 1 is a flow sheet illustrating the process of the invention.

In the practice of the preferred embodiment of the invention, the fuel containing sulfur and ash-forming materials is mixed, prior to combustion, with an additive capable of reacting during combustion with the sulfur in the fuel. A particulate binding agent may also be added to facilitate the formation of a removable ash in the form of solid or molten slag.

The fuel may comprise a dry, coarsely ground, coal, i.e., $\frac{1}{4}$ to $\frac{1}{2}$ inch particles, a dry, pulverized coal, i.e., having an average particle size of $-200$ mesh (Tyler); or the pulverized coal may be mixed with water to form a slurry to facilitate intimate contact with the additives.

The use of water in the fuel mix to form a slurry, while not necessary, provides several important advantages. It acts as a vehicle for the fuel when particulate coal is used allowing it to be handled as a liquid or as a stiff paste. It also promotes the intimate association of the additive with the particulate carbonaceous material that is necessary to maximize the effect of the additive by bringing the additive and the sulfur in the carbonaceous material in intimate association with one another. A water-based slurry may also be stored without fear of spontaneous combustion or excessive dust generation.

The additive capable of reacting with sulfur in the fuel may comprise a material containing a metal, including an alkali metal or an alkaline earth metal, capable of reacting with sulfur to form a compound. The metal may be in metallic form, a salt or an oxide. Examples of such materials incude calcium oxide, calcium carbonate, dolomite, magnesium oxide, sodium carbonate, sodium bicarbonate, iron oxide and clay. The inclusion of the particular additive in the initially formed fuel mix may also alter the melting point of the subsequently formed ash. The selection of a particular additive for use in the fuel mix should, therefore, accomodate the desired temperatures of the first and second stages to ensure that a molten slag does not form from the ash particulate in the first stage and to ensure that the molten slag will form in the second stage so that the amount of particulates leaving the second stage will be substantially reduced to thereby reduce the amount of particulates which will eventually be emitted to the atmosphere from the third stage. Certain additives, such as calcium oxide, calcium carbonate, dolomite and magnesium oxide may act to increase the melting temperature of the ash while sodium carbonate, sodium bicarbonate, and clay may act to decrease the melting temperature of the ash. Under certain circumstances, it may be desirable to utilize an additive mixture comprised of a mixture of these preferred materials.

If the fuel mix also contains a particulate binding agent, reduced particulate emission during combustion may be achieved. This may be due to a binding of the carbonaceous particles that occurs when the binding agent is present in the fuel mix during the initial heating thereof in the first stage combustion chamber prior to combustion. Preferred binding agents for addition to the slurry include clay, sucrose, calcium acetate and acetic acid.

The fuel mix may be blown into the first stage combustion chamber by a high velocity stream of air when a dry fuel mix is used or, if a slurry is used, the fuel mix is fed into the first stage combustion chamber by a suitable feed mechanism, such as a mechanical screw device or the like, or blown in dispersed as small droplets. In the first combustion zone, the fuel mix is burned in the presence of less than 75%, or in some instances, less than 50% of the theoretical air needed for complete combustion. When coarse particles are used, a fluidized bed combustor may be utilized in the first stage.

The temperature is controlled in the first stage of combustion to maintain the temperature at from 700°–1100° C. and, preferably at a temperature between 850° and 1100° C. At these temperatures, a reaction between the fuel mix constituents and the oxygen in the air of combustion forms sulfur compounds, such as hydrogen sulfide, carbonyl sulfide and sulfur dioxide. These compounds, in turn, may then react with the additive to form sulfides and sulfites. Some of the sulfites thus produced are thermally unstable at high temperatures. Thus, for example, calcium sulfite begins to decompose to calcium oxide and sulfur dioxide at about 900° C., and it is almost completely unstable at temperatures above 1100° C. Therefore, since the invention contemplates the removal, as solids, of the compounds formed by reaction of the additive with the sulfur, it is desirable that the temperature be maintained low enough to prevent such decomposition and formation of sulfur-bearing gases. The temperature may be maintained below 1100° C. during combustion by introducing steam into the chamber with the combustion air, or more preferably, by the limitation of the amount of air introduced into the chamber. It should be noted in this regard that localized hot spots may exist in the chamber at temperatures above 1100° C. In the presence of such hot spots, it is still considered to be within the perview of maintaining the overall temperature of the chamber below 1100° C. as it may be almost impossible to eliminate such hot spots.

Maintaining the temperature in the first stage below the melting point of the ash also assists in the fuel mix by providing a larger surface area for reaction than would be present if molten slag was formed in the first reaction zone.

Limitation of the amount of air introduced into the first chamber to less than 75% theoretical air, and, in some instances, less than 50%, has the added benefit of causing the major portion of the sulfur and the carbonaceous material to form sulfides with the additive, e.g. calcium sulfide or iron sulfide, which are thermally stable at the temperatures used in the first stage of the combustion. Thus, the emission of sulfur oxides may be significantly reduced by limitation of the amount of air introduced into the first stage combustion chamber to less than 75% theoretical air. The operation of the first stage combustion chamber with less than 75% theoretical air also reduces the formation of oxides of nitrogen. The use of preheated air may result in the need for even less air to achieve the same combustion temperatures.

The solid materials formed in the first stage of the combustion, consisting principally of the reaction products of the additive and the sulfur in the fuel and ash products, may be partially removed as solids from the bottom of the first combustion chamber or they may be passed to the second combustion stage.

The amount of solids which are respectively either removed from the stream or passed on to the second reaction zone will be dependent upon several factors. If the majority of the sulfur compounds formed are stable sulfides, it may be preferable to pass these compounds on to the second stage where they will form, with the molten slag, a relatively unleachable mass. On the other hand, if the majority of the sulfur compounds formed are unstable sulfites, it will be advantageous to remove these compounds as solids from the first reaction zone since their presence in the higher temperature second reaction zone may result in decomposition and formation of undesirable sulfur-containing gases. If at least some of the sulfur compounds are removed in the first reaction zone, large particles of ash may be removed at the same time. However, finely divided ash is advantageously passed to the second reaction zone where the cyclone effects in that zone will bring the finely divided ash particles into contact with the slag-coated walls of the second reaction zone resulting in the melting of the finely divided particles into molten slag which can then be removed.

The hot combustion gases, together with at least the fine ash not removed from the first stage, are passed through a flue into a second combustion chamber which is maintained at a temperature above 1100° C. and preferably at 1100° to 1400° C. to aid in the formation of a liquid or solid slag from the ash-forming materials found in the combustible fuel. For any particular fuel, the temperature in the second stage is optimally maintained at about 50° to 100° C. over the slag melting point to insure melting of the ash while maintaining as low a temperature as possible from the standpoint of decomposition of any sulfur compounds passing into the second stage.

This second combustion stage also uses less than 100% theoretical air, based on the air requirements of the gases from the first stage, to reduce the formation of oxides of nitrogen and sulfur. The temperature of the second stage should be high enough to melt the ash to form a molten slag which will fall by gravity to the bottom of the combustion chamber where it may be easily removed. Melting of the finely divided ash is facilitated by cyclone action of the air blown into the second combustion stage which propels the ash against the molten slag-coated walls of the second combustion stage.

The combustion gases are now passed to a third stage wherein they are burned to completion with an excess of air. At this stage, the fuel values in the combustible gases should be substantially free of any sulfur or ash-forming materials; therefore, this stage may be operated to maximize the burning of any remaining combustible fuel values in the gas.

Figure 2:
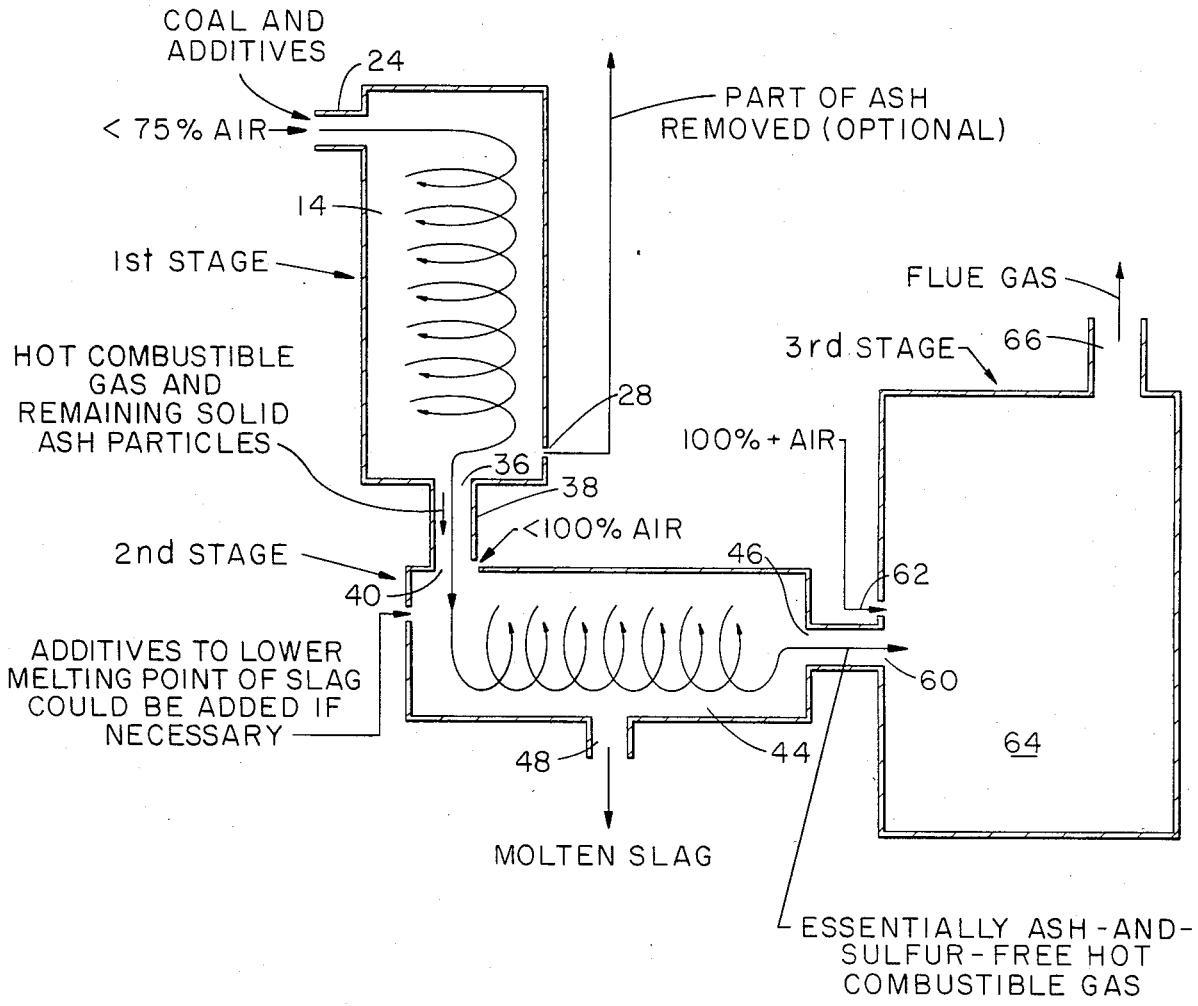
FIG. 2 is a cross-sectional schematic illustrating a preferred apparatus useful in the practice of the invention.

Referring now to FIG. 2, a combustion apparatus is schematically depicted for practice of the method of this invention. The apparatus includes first stage combustion chamber 14, second stage combustion chamber 44 and third stage combustion chamber 64.

The fuel mix, including the fuel and additives, as well as air for combustion in the first stage, enter chamber 14 at inlet 24. As has been mentioned, less than 75% theoretical air is supplied in the first stage, preferably in such a way as to maintain the temperature therein below about 1100° C., and preferably at about 850° to 1050° C. During combustion, the additive in the fuel slurry will combine with sulfur in the fuel to form compounds which will accumulate in the form of solids in the bottom of the chamber.

As these compounds accumulate during the first stage of combustion, they may be optionally removed from chamber 14 through a disposal port 28 together with large particles of ash resulting from ash-forming materials present in the fuel. Such ash-forming materials will also result in the formation of finely divided particulate ash which may be kept in suspension in the combustible fuel in the form of finely divided particles of ash by a cycloning effect through the introduction of the air to form a swirling effect within the first stage of combustion. The combustible gases from chamber 14, together with the finely divided ash, exit chamber 14 at outlet 36 and pass through conduit 38 to second stage combustion chamber 44. Entering this chamber at inlet 40, these gases are mixed with additional air to maintain a cycloning of the gases in second combustion chamber 44.

Further combustion is carried out in the second combustion chamber at a temperature above 1100° C. to cause the burning of further fuel values as well as the melting of the particulate ash to form a molten slag which coats the walls of second combustion chamber 44 and then runs down the walls to accumulate at the bottom of chamber 44 where it may be removed through a slag disposal port 48. The cycloning effect by the air entering second combustion chamber 44 causes the fine ash particulate to contact the molten slag coated walls, causing the fine ash particles to stick to the molten slag and melt.

The combustion gases from chamber 44, which should now be relatively free of particulate matter, exit through outlet port 46 wherein they pass to third combustion chamber 64 at inlet 60. These gases in chamber 64 are then mixed with air through an air inlet 62 wherein combustion is completed. The exhaust from chamber 64 exits through exhaust outlet 66 for discharge to the atmosphere or further treatment depending upon the amount of gases or particulates passing through outlet 66.

Thus, the process of the invention provides three stages of combustion wherein sulfur compounds are formed from sulfur in the fuel mix and optionally removed in the first stage, molten slag is formed and removed in the second stage from ash-forming materials in the fuel mix, and the emissions from the third and final stage are, therefore, relatively free of both sulfur and particulates.

Having thus described the invention, what is claimed is:

1. A three-stage combustion process for burning a fuel containing sulfur characterized by low sulfur emission and good ash removal comprising:

(a) mixing the sulfur containing fuel with an additive capable of reacting with sulfur;

(b) burning the mixture in a first combustion stage with less than 75% theoretical air and at a temperature below the melting point of the ash but sufficiently high to cause reaction between said additive and any sulfur in said fuel to facilitate removal of the sulfur compounds formed;

(c) passing combustible fuel gases from said first stage to a second combustion stage;

(d) burning said gases in said second stage with less than 100% theoretical air, based on theoretical air for products from the first stage, at a temperature above the melting point of the ash to form a liquid slag which is removable from said second stage; and (e) burning combustible gases from said second stage in a third stage with an excess of air to ensure complete combustion of said fuel.

2. The process of claim 1 wherein said additive is first mixed with water prior to mixing said additive with said sulfur containing fuel.

3. The process of claim 2 wherein said fuel comprises a particulate carbonaceous fuel and said water and said water and additive are mixed with said particulate carbonaceous fuel to form a slurry whereby said additive may come in intimate contact with said sulvur in said fuel.

4. The process of claim 1 wherein said particulate carbonaceous fuel comprises coal and said temperature in said first stage is maintained below 1100° C. to prevent ash formed by said burning coal from melting whereby reaction between said additive and sulfur in said fuel in said first stage to form sulfur compounds is facilitated.

5. The process of claim 4 including the further step of removing at least a portion of the sulfur compounds formed in said first stage prior to passage into the second stage whereby said sulfur compounds formed in said first stage will not be exposed to the higher temperatures of the second stage which might decompose said sulfur compounds to form undesirable sulfur gases.

6. The process of claim 5 wherein at least a portion of said ash formed in said first stage is passed to said second stage with combustible fuel from said first stage whereby said ash may be melted into a recoverable form at the higher temperature of said second stage.

7. The process of claim 5 wherein the temperature in said first stage is maintained below 1100° C.

8. The process of claim 6 wherein the temperature in said first stage is between about 850° to 1050° C.

9. The process of claim 6 wherein the temperature in said second stage is maintained above 1100° C.

10. The process of claim 9 wherein the temperature in said second stage is from 1100° to 1400° C.

11. The process of claim 1 wherein said additive capable of reacting with sulfur is selected from the class consisting of a metal in metallic form, a metal oxide or a metal salt.

12. The process of claim 11 wherein said additive contains a material capable of reacting with sulfur selected from the class consisting of an alkali metal, an alkaline earth metal and mixtures thereof.

13. The process of claim 11 wherein said additive contains an alkali metal capable of reacting with sulfur to form a compound removable from said first combustion stage.

14. The process of claim 1 wherein a binding agent is added to said carbonaceous fuel to reduce the particulate emission from said combustion process.

15. A three-stage process for burning a particulated carbonaceous fuel containing sulfur and ash-forming materials comprising:

(a) forming a slurry of said particulated carbonaceous fuel, water and an additive capable of reacting with said sulfur to form one or more removable compounds;

(b) burning said slurry in a first combustion stage with less than 75% theoretical air at a temperature below the melting temperature of ash in said fuel to form said removable sulfur-containing compounds;

(c) removing said sulfur-containing compounds;

(d) burning combustible materials from said first stage in a second combustion stage with less than 100% of the theoretical air needed for the combustible materials from said first stage, at a temperature above the melting point of ash in said combustible materials from said first stage;

(e) removing said ash as a slag; and (f) burning combustible materials from said second stage in a third combustion stage with an excess of air whereby the emissions from said third stage of sulfur-containing gases and particulates will be substantially lowered.

16. The process of claim 15 wherein said particulate carbonaceous fuel is formed by grinding coal.

17. The process of claim 16 wherein said coal is ground to a particle size range of less than 200 mesh (Tyler).

18. The process of claim 17 including the step of adding a binder to said slurry to aid in forming said slag.

19. A three-stage process for burning a particulated carbonaceous fuel containing sulfur and ash-forming materials comprising:

(a) forming a slurry of said particulated carbonaceous fuel, water and an additive capable of reacting with said sulfur to form one or more removable compounds;

(b) burning said slurry in a first combustion stage with less than 75% theoretical air at a temperature below the melting temperature of ash in said fuel to form said removable sulfur-containing compounds;

(c) removing at least a portion of said sulfur-containing compounds from said first combustion stage;

(d) passing the remainder of the materials from said first combustion stage to a second combustion stage;

(e) burning combustible materials from said first stage in a second combustion stage with less than 100% of the theoretical air needed for the combustible materials from said first stage at a temperature above the melting point of ash in said combustible materials from said first stage;

(f) removing said ash as a slag; and (g) burning combustible materials from said second stage in a third combustion stage with an excess of air whereby the emissions from said third stage of sulfur-containing gases and particulates will be substantially lowered.

* * * * *